US006164902A

United States Patent [19]

Irwin et al.

[11] Patent Number: 6,164,902

[45] Date of Patent: Dec. 26, 2000

[54] CONTROLLING STALL MARGIN IN A GAS TURBINE ENGINE DURING ACCELERATION

[75] Inventors: Craig W. Irwin, Jupiter; Syed J. Khalid, Palm Beach Gardens, both of Fla.

[73] Assignee: United Technologies Corporation, Hartford, Conn.

[21] Appl. No.: 09/209,628

[22] Filed: Dec. 11, 1998

[51] Int. Cl.[7] ..... F01B 25/00

[52] U.S. Cl. ..... 415/17; 415/118

[58] Field of Search ..... 415/17, 26, 28, 415/47, 48, 49, 50, 118; 701/100, 101; 60/39.29, 39.27

[56] References Cited

U.S. PATENT DOCUMENTS

| | | | |
|---|---|---|---|
| 4,060,980 | 12/1977 | Elsaesser et al. | 60/39.03 |
| 4,118,926 | 10/1978 | Curvino et al. | 60/39.06 |
| 4,228,359 | 10/1980 | Matsumoto et al. | 290/40 R |
| 4,581,888 | 4/1986 | Schmitzer et al. | 60/39.091 |
| 4,901,061 | 2/1990 | Twerdochlib | 340/604 |
| 5,165,845 | 11/1992 | Khalid | 415/17 |
| 5,357,748 | 10/1994 | Khalid | 60/204 |
| 5,375,412 | 12/1994 | Khalid et al. | 60/39.29 |
| 5,385,012 | 1/1995 | Rowe | 60/39.02 |
| 5,752,379 | 5/1998 | Schafer et al. | 60/39.24 |

*Primary Examiner*—Edward K. Look
*Assistant Examiner*—James M. McAleenan
*Attorney, Agent, or Firm*—Monica G Krasinski; Gene D. Fleisenhhauer

[57] ABSTRACT

A control system for controlling the compressor stall margin during acceleration in a gas turbine engine includes means for sensing signals indicative of the gas flow temperature and gas pressure. The control system further includes signal processing means, responsive to the sensed signals, for synthesizing and providing a processed signal indicative of a measure of compressor destabilization due to heat transfer effects. The control system also includes means, responsive to the processed signal, for providing an output to initiate corrective action to increase compressor stall margin if needed. The engine control means, which is a part of the control system, increases the compressor stall margin by either adjusting the compressor variable vanes, reducing fuel flow or modulating the compressor bleed.

7 Claims, 1 Drawing Sheet

CONTROLLING STALL MARGIN IN A GAS TURBINE ENGINE DURING ACCELERATION

The invention was made under a U.S. government contract, and the U.S. government has rights herein.

TECHNICAL FIELD

This invention relates to the control of gas turbine engine compressors and more particularly to controlling stall margin in gas turbine engines.

BACKGROUND ART

The phenomenon of compressor stall has become an important limiting factor in the operation of gas turbine engines as their performance characteristics have improved. In modern gas turbine engines, upon acceleration or under high altitude and lower speed flight conditions, unstable flow may develop in the compressor which can lead to a stall with a resultant increase in turbine temperature and mechanical vibration along with a simultaneous reduction in cooling air supplied to the turbine. These conditions describe "compressor stall" and can lead to turbine failure if the compressor stall is not recognized and corrective action not taken. Turbine failure during engine operation can lead to severe engine and aircraft damage.

It is known that during transient engine operation, such as during engine acceleration or deceleration, the thermal characteristics (the temperatures of the gas flow and metals) of the compressor components are not the same as they are during steady-state conditions. During an engine transient condition, there is a heat transfer between the gas flowing through the compressor and the metallic case, blades and stators of the compressor. Heat flows from the metallic case, blades and stators to the gas flowing through the compressor, thus increasing the gas temperature. This results in the temperature of the gas flowing through compressor being higher at the exit end of the compressor than in the front of the compressor for a given speed than the corresponding steady-state temperature. As a result, there is a difference or mismatch in the pressure ratios and thermal characteristics between the front stages of the compressor and the aft stages of the compressor due to heat transfer effects, which adversely affects compressor stability. It is undesirable to have a mismatch of gas flow thermal and pressure characteristics through the compressor stages as it may lead to the aft stages operating at lower corrected speeds as the speed is correlated with the gas flow temperature. The compressor's stability is compromised during the mismatch of gas flow characteristics as the front stages may have a much higher pressure ratio than the aft stages leading to a potential stall condition. For example, during deceleration from high to low power, heat transfer effects from the hot metal parts (case and airfoils) reduces the rate with which the gas flow temperature decreases from the temperature corresponding to the steady-state characteristic. Without heat transfer effects, the gas flow temperature would decrease at a faster rate and reach a lower temperature. The heat transfer effect tends to lower the corrected compressor speed of the rear or aft stages of the compressor. This detracts from the suction capability of the aft stages. In other words, the gas flow experiences a resistance as it flows axially downstream the engine flow path. The forward stages thus get back pressurized and, in turn, the operating line for those forward stages approaches the stall line, decreasing the stall margin.

The thermal characteristics of the engine can be synthesized or calculated using sensed parameters to control the deflection of the stator blades and fuel flow to provide an acceptable level of stall margin during acceleration and subsequent thermal nonequilibrium condition. For example, U.S. Pat. No. 5,165,845, assigned to the assignee of the present invention, discloses a control system for modifying engine airflow geometry to increase the compressor stall margin during engine acceleration by synthesizing the thermal enlargement of critical compressor stages. This thermal enlargement provides a measure of the temporary increase in blade-case clearance during acceleration. The change in clearance is used to provide a signal, which in turn increases stator vane deflection during acceleration until the clearance returns to a nominal level.

The above-described prior art method increases stall margin during high power thermal stabilization when tip clearances get large. However, even though prior art methods compensate for stall margin loss due to increased tip clearances, stall margin loss due to mismatch of gas flow characteristics aggravated by heat transfer effects have not been adequately understood and addressed. Other prior art control systems to increase stall margin, due to their reliance on a plurality of flow measurements, are complex to implement and are not robust.

DISCLOSURE OF THE INVENTION

An object of the present invention is the provision of a measure of thermal destabilization of the compressor of the gas turbine engine due to heat transfer effects.

A further object of the present invention is the provision of an improved control of stall margin during engine acceleration.

The present invention is predicated on the fact that during transient engine operation, there is a mismatch of gas flow through the compressor stages, due to heat transfer effects which adversely affect compressor stability. The present invention synthesizes a signal indicative of a normalized adverse heat transfer parameter which is a measure of compressor destabilization. The present invention provides corrective action and maintains an adequate compressor stall margin if the compressors stability is compromised.

According to the present invention, a control system for controlling the compressor stall margin during a transient condition in a gas turbine engine includes means for sensing signals indicative of the gas flow temperature and gas pressure. The control system further includes signal processing means, responsive to sensed signals, for synthesizing and for providing a processed signal indicative of a measure of compressor destabilization due to heat transfer effects. The control system further includes output means, responsive to the processed signal, to effectuate corrective action to increase compressor stall margin. For example, the output means may include an engine control means which is a part of the control system. The engine control means, in response to the synthesized signal, increases stall margin by either adjusting the compressor variable airflow geometry, fuel flow reduction or by modulating the compressor bleed valve.

In a preferred embodiment, the signal processing means includes means for calculating metal temperatures of the blades and case, means for calculating the derivatives of the metal temperatures which is indicative of the rate of heat transfer, means for combining metal temperature rate with metal mass, and means for normalizing the combined signal with total gas enthalpy for synthesizing a dimensionless heat transfer parameter. The output means increases compressor stall margin by opening a mid-compressor bleed valve to relieve the back pressure of forward stages, or by closing compressor variable vanes or by lowering the fuel flow schedule during re-acceleration which lowers the high pressure compressor operating line and thereby increases the compressor stall margin.

The present invention has utility in that it provides for an improved control system for controlling the stall margin during engine transient conditions especially during an acceleration following a deceleration. The present invention accomplishes the control of the stall margin by synthesizing a measure of compressor destabilization due to heat transfer effects.

The foregoing and other objects, features and advantages of the present invention will become more apparent in the following detailed description of the best mode for carrying out the invention and from the accompanying drawings which illustrate an embodiment of the invention.

BEST MODE FOR CARRYING OUT THE INVENTION

Figure 1:
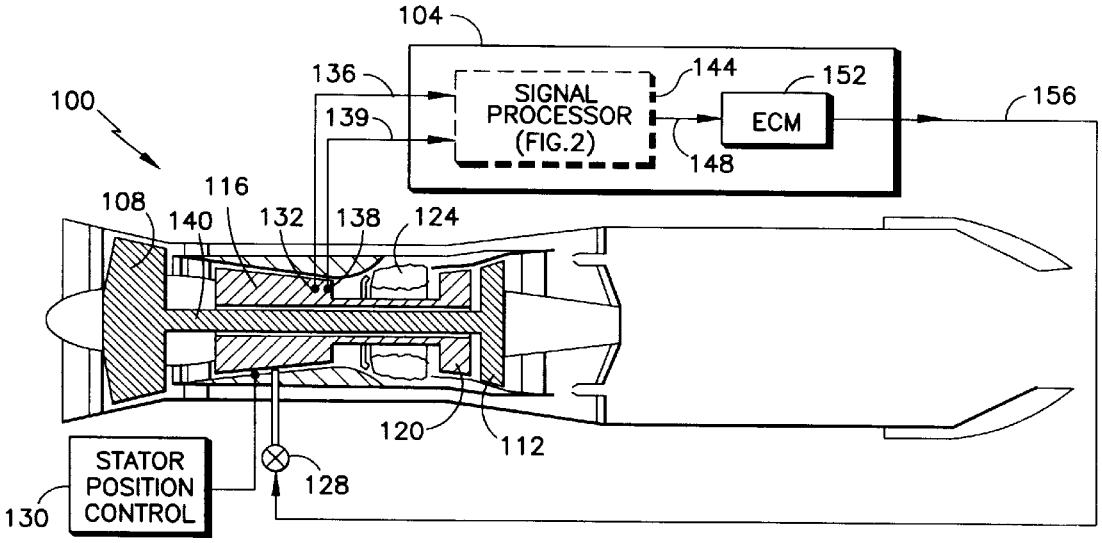
FIG. 1 is an illustration of a gas turbine engine incorporating the control system of the present invention.

Referring to FIG. 1, there illustrated is an exemplary embodiment of a known, twin-spool turbofan engine 100, together with a corresponding control system 104 having the present invention implemented therein, as described in detail hereinafter. The engine comprises a low pressure compressor 108, connected through a shaft to a low pressure turbine 112; a high pressure compressor 116 connected through a shaft to a high pressure turbine 120; and a burner section 124 disposed between the high pressure compressor 116 and high pressure turbine 120. A bleed valve 128 is disposed between the forward and aft stages of the high pressure compressor to discharge compressor air from the compressor flow path into the fan flow path during certain engine operating conditions. In addition, the engine is assumed to have mechanisms to vary airflow geometry, such as compressor variable vanes. For present purposes, it is sufficient to understand that the deflection of the vanes is varied by a stator position control 130.

A temperature sensor or transducer 132 may preferably be located in the gas flow path at the discharge of the compressor. A pressure sensor or transducer 138 may preferably be also located in the gas flow path at the discharge of the compressor. Placement of the temperature and pressure sensors varies for engine types.

The gas flow temperature on signal line 136 is an input provided to the control system 104 of the present invention. The gas pressure on line 139 also forms an input to the control system 104. The control system 104 of the present invention includes a signal processor 144 for processing the sensed gas flow temperature and pressure. Details of the signal processor 144 are provided hereinafter with respect to the discussion regarding FIG. 2. The output signal of the processor on line 148 is provided to the engine control means 152. The engine control means, in response to the output signal, increases the compressor stall margin by sending a signal on line 156 to either the compressor bleed valve or compressor variable vanes. In FIG. 1, the signal line 156 is shown as being connected to the compressor bleed valve 128. Although not shown, the signal line 156 may be connected to the stator position control 130 which modulates the deflection of the compressor variable vanes to vary airflow geometry.

Figure 2:
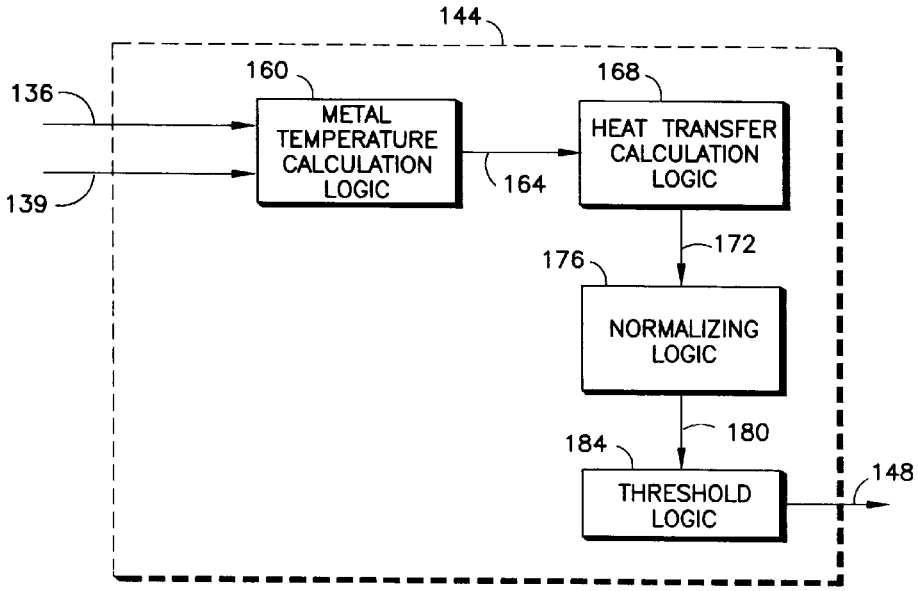
FIG. 2 is a block diagram of the signal processing logic that is a part of the control system of FIG. 1.

Illustrated in FIG. 2 is a block diagram of the signal processor 144 of the control system in accordance with an exemplary, preferred embodiment of the present invention. The signal processor 144 has two inputs thereto. The signal on line 136, indicative of the gas flow temperature in the compressor, forms an input to the metal temperature calculation logic block 160. A second input on line 139 indicative of gas pressure also forms an input to the logic block 160. This logic block 160 calculates temperatures that are proportional to actual metal temperatures (stators/blades and case) by applying a first order lag to the gas flow temperature. The amount of lag varies between the case and stators/blades and is a function of metal mass and a function of the gas pressure.

The output of the metal temperature calculation logic block 160 on signal line 164 forms the input to the heat transfer calculation logic block 168. This logic in block 168 calculates a heat transfer parameter by differentiating metal temperatures for the case and stator/blades. Heat transfer is proportional to the derivative of the metal temperatures. Thus, the heat transfer parameter is calculated by taking the product of the metal temperature derivatives and the metal mass for each component (case and stator/blades) and summing the terms.

The output of the heat transfer calculation logic block 168 on signal line 172 forms the input to the normalizing logic block 176. This logic block 176 calculates a dimensionless heat transfer parameter by dividing the output of logic block 168 by the product of gas flow and temperature. This dimensionless heat transfer parameter is a measure of the amount of heat imparted to the gas flow by the surrounding metal and is indicative of compressor thermal destabilization. This logic combines the metal temperature rates with the metal mass and then normalizes the sum to the total gas enthalpy as evidenced by the following equation:

$$\frac{TcdotM_C + TBdotM_B}{(MGdot)T_3} \quad \text{(Eq. 1)}$$

where Tcdot is the derivative of the case temperature, $M_c$ is the mass of the case, TBdot is the derivative of the blade temperature, $M_B$ is the mass of the blades, MGdot is the derivative of the mass of the gas and $T_3$ is the gas flow temperature.

The output of the normalizing logic block 176 on signal 180 indicative of a measure of compressor thermal destabilization due to heat transfer effects, forms an input into the threshold logic block 184. The value on signal line 180 is compared to a threshold value indicative of a healthy compressor which does not have a compromised stability margin as a result of thermal mismatching. The threshold is determined by measuring the high-pressure compressor stability margin of an engine during steady state operation and during thermal transients with progressively increasing severity. The threshold is then the level at which control action is required to maintain adequate stability margin and varies for different engine types.

If the value on signal line 180 is greater than the threshold, then the threshold logic 184 outputs a processed signal on signal line 148. This processed signal on signal line 148 is an input to the engine electronic control unit 152. The engine electronic control unit processes the processed signal to output a command on signal line 156 that triggers the modulation of the compressor bleed valve 128 to increase stall margin. In the alternative, the output command on signal line 156 may trigger the correction of the variable airflow geometry using the stator position control 130 of the compressor to increase stall margin.

The control system of the present invention may be implemented in a variety of ways. As described hereinbefore, the control system of the present invention may utilize digital engine controls. Alternatively, the engine may be implemented in a dedicated microprocessor separate from the engine control. Whenever a microprocessor or the like is used for implementing the invention, such as in a digital engine control, the invention may be implemented in software therein. The invention can be implemented using hard-wired logic or analog circuitry.

Further, the control system of the present invention has been described using particular gas flow temperature and gas pressure input signals from sensors or transducers located at particular aft stage locations in the high-pressure compressor. However, the input signals and locations are purely exemplary; the control system can be operated with other temperature and pressure parameters sensed by transducers located at different locations in the high-pressure compressor. Further, the specific components described and illustrated for carrying out the specific functions of the control system of the present invention are purely exemplary, it is to be understood that other components may be utilized in light of teachings herein. Such components should be obvious to one of ordinary skill in the art. For example, the control system of the present invention has been described with a compressor bleed valve or a variable air flow geometry as the mechanism to increase stall margin. The stall margin may also be increased by modulating fuel flow which decreases the compressor operating line thereby increasing the stall margin.

The calculations and logic illustrated for carrying out the control system of the present invention are purely exemplary. Other logic can be utilized in light of the teachings herein. The signal processing means of the present invention has been described as having the following logic blocks: metal temperature calculation logic, heat transfer calculation logic, normalizing logic and threshold logic. The metal temperature calculation logic has been described to include the application of a first order lag to the gas flow temperature. The amount of lag has been described as a function of metal mass and gas pressure. It is to be understood that the metal temperature can be calculated by applying a lag to parameters other than gas flow temperature such as actual measured metal (case) temperature and the magnitude of the lag can be varied as a function of different parameters such as air flow, compressor speed, and mass flow through compressor.

Further, the normalizing logic has been described as using the total gas enthalpy as the normalizing parameter. It is to be understood that other parameters such as gas temperature can be used to normalize the processed signal.

It will be understood by those skilled in the art that the above-described limits and thresholds are experimentally derived for particular engine types. Other limits and threshold may be utilized in light of the teachings herein.

All of the foregoing changes and embodiments are representative of the preferred embodiment, it suffices for the present invention, that a control system for controlling the compressor stall margin during a transient condition in a gas turbine engine includes means for sensing signals indicative of the gas temperature and pressure, processing means, responsive to sensed signals, for synthesizing a signal indicative of a measure of compressor destabilization due to heat transfer, and output means, responsive to synthesized signal, to effectuate corrective action to increase compressor stall margin.

Although the invention has been shown and described with respect to detailed embodiments thereof, it should be understood by those skilled in the art that various design changes in form and in detail thereof may be made without departing from the spirit and the scope of the claimed invention.

What is claimed is:

1. A control system for a gas turbine engine during transient engine conditions, the engine having a case formed of a metallic material, a compressor operating with a stall margin including rows of blades, and stator vanes both formed of a metallic material, comprising:

input means for sensing and providing sensed signals indicative of a temperature and pressure of a gas flowing through the compressor; and signal processing means, responsive to the sensed signals, for calculating at least one rate of temperature change of the metallic materials in the compressor, for combining the at least one rate of temperature change with the mass of the metallic materials, and for normalizing the combination to the total gas enthalpy, to provide a processed signal indicative of a measure of compressor destabilization due to heat transfer effects, and for providing the processed signal to increase the compressor stall margin.

2. The control system as described in claim 1, further includes output means, responsive to the processed signal, for providing an output signal to initiate corrective action to increase the compressor stall margin.

3. The control system as described in claim 2, further includes an engine control means, responsive to the output signal, for modifying engine airflow geometry to increase compressor stall margin.

4. The control system as described in claim 2, further includes a compressor bleed valve and an engine control means, responsive to the output signal, for modulating the compressor bleed valve to increase compressor stall margin.

5. The control system as described in claim 1, wherein said signal processing means provides a processed signal indicative of a measure of compressor destabilization by applying a first order lag to the gas flow temperature to calculate proportional metal temperatures of the blade and case, calculating derivatives of the metal temperatures indicative of a heat transfer parameter, and calculating a dimensionless heat transfer parameter indicative of compressor destabilization.

6. The control system as described in claim 1, wherein the signal processing means for processing the sensed signal further includes comparison means to compare the processed signal to a predetermined threshold to determine if corrective action is required to increase stall margin.

7. The control system as described in claim 5 wherein the function of applying a first order lag to the gas flow temperature is performed by applying a first order lag to the gas flow temperature at the exhaust of the compressor.

* * * * *